US007776233B2

(12) United States Patent
Arafat et al.

(10) Patent No.: US 7,776,233 B2
(45) Date of Patent: Aug. 17, 2010

(54) OLEAGINOUS CORROSION RESISTANT COMPOSITION

(75) Inventors: El Sayed Arafat, Leonardtown, MD (US); Judy Butler-Kowalik, Hollywood, MD (US); Kenneth Clark, Chalfont, PA (US); David L. Gauntt, Chestertown, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1078 days.

(21) Appl. No.: 11/264,336

(22) Filed: Oct. 27, 2005

(65) Prior Publication Data

US 2007/0096059 A1 May 3, 2007

(51) Int. Cl.

| | |
|---|---|
| ***C23F 11/00*** | (2006.01) |
| ***C23F 11/12*** | (2006.01) |
| ***C23F 11/16*** | (2006.01) |
| ***C23F 11/167*** | (2006.01) |
| ***C07C 309/62*** | (2006.01) |
| ***B05D 1/00*** | (2006.01) |
| ***B05D 1/18*** | (2006.01) |

(52) U.S. Cl. ..... 252/395; 252/389.2; 252/389.21; 252/389.22; 252/389.52; 252/389.61; 252/391; 252/406; 252/409; 106/14.13; 106/14.16; 106/14.12; 508/390; 508/408; 508/388; 508/184; 508/389; 208/18; 208/19; 427/435; 427/207.1; 427/287

(58) Field of Classification Search ..... 252/389.21, 252/391, 395; 508/388, 389; 106/14.13, 106/14.12; 427/435

See application file for complete search history.

(56) References Cited

U.S. PATENT DOCUMENTS

| | | | | |
|---|---|---|---|---|
| 2,378,820 | A * | 6/1945 | Amott | 508/313 |
| 2,404,871 | A * | 7/1946 | Van Ess et al. | 508/567 |
| 3,350,308 | A * | 10/1967 | McMillen | 508/392 |
| 3,480,550 | A * | 11/1969 | Henderson et al. | 508/391 |
| 3,624,208 | A * | 11/1971 | Schmolka | 514/785 |
| 4,218,329 | A * | 8/1980 | Koh | 508/170 |
| 5,169,564 | A * | 12/1992 | Gallacher et al. | 252/400.52 |
| 5,326,566 | A * | 7/1994 | Parab | 424/401 |
| 5,549,787 | A * | 8/1996 | Sain et al. | 162/5 |
| 5,726,134 | A * | 3/1998 | Adams | 508/391 |
| 5,902,572 | A * | 5/1999 | Luebbe et al. | 424/66 |
| 6,432,432 | B1 * | 8/2002 | Mohseni et al. | 424/405 |
| 6,551,967 | B2 * | 4/2003 | King et al. | 508/391 |
| 6,596,672 | B1 * | 7/2003 | Carrick et al. | 508/192 |
| 6,617,287 | B2 * | 9/2003 | Gahagan et al. | 508/192 |
| 7,407,917 | B2 * | 8/2008 | Shiga et al. | 508/194 |
| 2003/0000866 | A1 * | 1/2003 | Cain | 208/18 |
| 2003/0134756 | A1 * | 7/2003 | Carrick et al. | 508/398 |
| 2006/0257441 | A1 * | 11/2006 | Komai et al. | 424/405 |

* cited by examiner

*Primary Examiner*—Joseph D Anthony
(74) *Attorney, Agent, or Firm*—Mark O. Glut

(57) ABSTRACT

The invention relates to an oleaginous corrosion-inhibiting composition, and the use of said composition to protect metal from corrosion. The composition comprises, in parts by weight, from about 20 to 60 parts of lubricating oil, 10 to 40 parts of organic solvent, 20 to 60 parts of corrosion-inhibitor consisting of a sulfonic acid-carboxylic acid metal complex or a mixture of said metal complex with a small but effective amount of an oil soluble alkyl phosphate, from 0.1 to 2.0 parts of an oil soluble antioxidant, from 0.1 to 5.0 parts of a water-displacing compound and from 0.0 to 1.0 part of a metal deactivator.

22 Claims, 2 Drawing Sheets

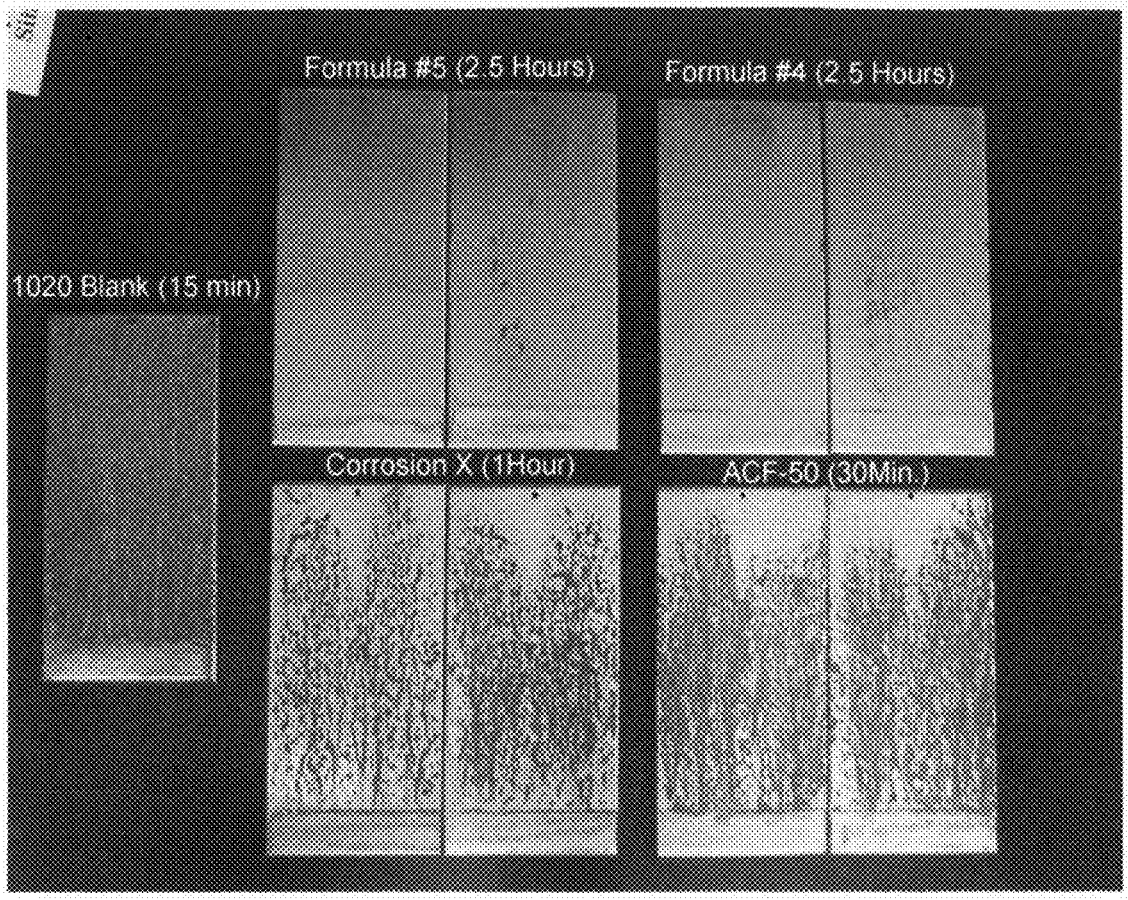
Figure (2) Salt Spray Test Results on Steel Panels After wiping off the CPC Products

OLEAGINOUS CORROSION RESISTANT COMPOSITION

ORIGIN OF INVENTION

The invention described herein was made by employee(s) of the United States Government and may be manufactured and used by or for the Government for governmental purposes without the payment of any royalties thereon or therefor.

BACKGROUND OF THE INVENTION

Field of the Invention

This invention relates to compositions and to the method of using said compositions to prevent the corrosion of metal. More specifically, this invention relates to oleaginous compositions comprising lubricating oils, organic solvents, corrosion inhibitors, rust preventive agents, antioxidants, metal deactivators and water-displacing agents. The oleaginous corrosion-resistant compositions of this invention are most useful as coating on various metal substrates including ferrous metal, aluminum, magnesium, ferrous alloy surfaces and are particularly useful as corrosion-inhibiting coatings for aircraft and automotive frames. For example, as aircraft age, corrosion often occurs in the internal structures which are not easily inspected or treated. Especially in harsh environments where humidity, salt and heat conspire to reduce metal parts to piles of oxide, fogging CPC's (Corrosion Preventative Compounds) into the internal spaces of airframes has been shown to be effective in combating metal degradation. However, the current CPC's must be reapplied several times annually, using time-consuming procedures. As an alternative to the current corrosion inhibitors, this invention provides high performance, long lasting, Corrosion Preventative Compounds (CPC's) for internal airframe applications to minimize the costs attributed to the aging aircraft.

BACKGROUND

CPC's are generally composed of a barrier film containing corrosion inhibitors, various other additives and sometimes a carrier solvent. Today, film-formers for CPC's include natural and synthetic oils, oxidized petroleum fractions and polymers, depending on the desired application and performance requirements. Mineral oil as well as wool wax have proven useful, but more recent developments involve the use of polymeric resins, including the acrylics, silicones, silicone alkyds, urethanes and other proprietary materials. Most of these film formers provide a physical barrier to the corrosive environment, but cannot prevent the slow diffusion of corrosive agents through the film. Some films, particularly the films containing the naturally derived materials, are not resistant to oxidation and require antioxidant additives to protect the film from degradation. In fact, without these and other additives, the barrier films often provide very poor corrosion-resistance. The blending of these additives in the film is usually the key to superior performance with minor differences in structure often producing major effects in staving off the corrosive attack of the environment.

Presently, corrosion preventative additives include not only anodic and cathodic inhibitors, but also acid acceptors and chelating agents. These agents provide a synergism with the film former that often produces outstanding corrosion protection. For example, calcium and barium salts of sulfonic acids (such as the alkylbenzenesulfonates and dinonylnaphthalene sulfonates) are outstanding metal deactivators resulting from the strong adsorption of the sulfonate group. The non-polar portion of the molecule tends to shield the surface from ionic attack from various environmental species. Phosphate compounds also have been used, most recently, in a difunctional additive where the distance between the phosphate moieties was optimized for a particular resin system. In addition, vapor phase corrosion inhibitors (such as the dicyclohexylammonium compounds, various amines, and benzoates) also may be useful in CPC films especially for internal applications where near-stagnant atmospheres exist.

Many CPC's contain carrier solvents which require evaporation to deposit the protective film. However, the use of solvents is regulated in many locations either by content (e.g. grams per liter volatile organic compounds (VOC)) or by vapor pressure. In addition to the solvent limitations, some additives previously used for their exceptional performance (such as barium sulfonates) are cited because of their heavy metal content. Substitute vehicles (such as water-borne resins) and substitute additives (such as calcium sulfonates) are possible, but only when the critical properties of the CPC performance are well understood.

Moreover, the formulation of CPC's has limitations. Higher concentrations of many additives results in higher viscosities causing the products to suffer performance problems. Ineffective water-displacement, incomplete crevice penetration, and poor sprayability are some of the problems that sooner or later contribute to the CPC's failure. Another approach to applying more corrosion-preventing additives is to use products that dry to thicker films, however, thicker CPC's attract hygroscopic dust and dirt and add considerable weight to small aircraft which leads to maintenance problems such as the inability to inspect a surface. In addition, there are several failure mechanisms for CPC's. Hard films fail when thermal expansion, mechanical movement or fatigue causes cracking of the substrate. Soft films fail when water slowly permeates and dissolves or emulsifies the CPC. Slow diffusion of environmental corrodents through a film will sooner or later initiate corrosion, damaging the film and allowing more direct attack on the surrounding metal. Some films can flow sufficiently to heal themselves in spite of repeated physical film damage, however, this also means that flow occurs when there is no damage, resulting in decreasing film thickness and subsequent loss of their corrosion preventative properties. Further, some additives to the CPC's catalyze the hydrolysis of film formers which leads to porosity or even complete destruction of the film. Even atmospheric oxidation of the film or UV radiation induced failure can occur prior to the expected life of the film.

SUMMARY OF THE INVENTION

This invention relates to oleaginous corrosion-resistant compositions and to the method of using said compositions to inhibit corrosion of various metal surfaces. The compositions comprise from about 20 to 60 parts by weight of at least one lubricating oil, 10 to 40 parts by weight of at least one organic solvent, 20 to 60 parts by weight of corrosion inhibitors, 0.1 to 2.0 parts by weight of antioxidants, 0.1 to 5.0 parts by weight of water-displacing compounds, and from 0.0 to 1.0 part by weight of metal deactivators.

Therefore, it is an object of this invention to provide an oleaginous corrosion-resistant composition and a method of using the composition to inhibit the corrosion of metal.

It is another object of this invention to provide an oleaginous corrosion-resistant composition as a liquid or semi-solid.

It is still another object of this invention to provide an oleaginous corrosion-inhibiting composition and a method of using the composition to form a coating on metal substrates.

These and other object of this invention will become apparent by reference to the detailed description when considered with the accompanying FIGS. 1 and 2.

DESCRIPTION OF THE DRAWINGS

FIG. 2 shows the salt spray test results on steel panels after wiping-off the corrosion-resistant composition of this invention in comparison to the blank and corrosion-resistant commercial products.

DETAILED DESCRIPTION OF THE INVENTION

Figure 1:
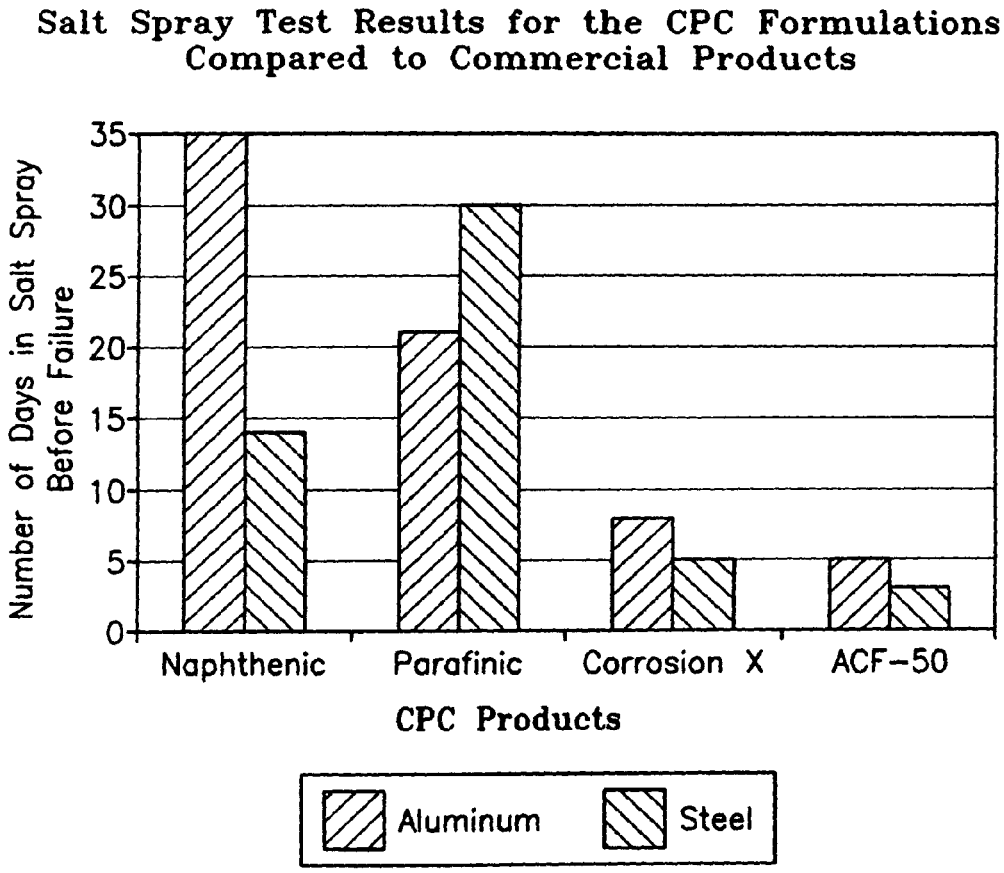
FIG. 1 shows the salt spray test results for the corrosion-resistant compositions of this invention on steel and aluminum in comparison to typical corrosion-resistant commercial products.

This invention relates to an oleaginous corrosion-resistant composition and to the method of inhibiting the corrosion of various metal surfaces including metal such as aluminum, aluminum alloys, and various ferrous metals such as steel. The oleaginous compositions of this invention comprise, in parts by weight, from about 20 to 60 parts and preferably 35 to 45 parts of at least one lubricating oil including mineral oils, synthetic oils and mixtures thereof in any ratio, from about 10 to 40 parts and preferably about 15 to 30 parts of at least one organic solvent such as petroleum distillates and various mixtures of these solvents in any ratio, from about 20 to 60 parts and preferably from 35 to 45 parts of an oil soluble corrosion inhibitor selected from the group consisting of a sulfonic acid-carboxylic acid metal complex and mixtures of said sulfonic acid-carboxylic acid metal complex with an oil soluble organic alkyl phosphate wherein said sulfonic acid-carboxylic acid metal complex ranges from about 97 to 99.9% by weight of the mixture, and the organic phosphate ranges from about 0.1% to 3.0%, or 0.5% to 1.0% by weight of the mixture, from about 0.1 to 2.0 parts and preferably 0.5 to 1.0 parts of an oil soluble organic antioxidant, from about 0.1 to 5.0 parts and preferably 1.0 to 2.0 parts of a water-displacing agent or compounds including the alkylene glycols, aliphatic alcohols, glycol ethers, ethers, ether alcohols, glycols, alkoxy alcohols, and preferably the lower alkylene glycols, and from 0.0 to 1.0 part and preferably from about 0.1 to 0.5 parts of an oil soluble heterocyclic metal deactivator such as the triazoles, and preferably benzotriazole or tolytriazole.

More specifically, the lubricating oils include oils of lubricating viscosity. These oils include natural and synthetic lubricating oils and mixtures thereof, having various viscosities, e.g. 5 W-40. Natural oils include the mineral lubricating oils such as the paraffinic and naphthenic oils or mixtures thereof. SHELLFLEX®-210 is a commercial oil product obtained from Shell Canada Limited. Synthetic lubricating oils include the hydrocarbon oils, alkylene oxide polymers such as the polymerization of ethylene oxide or propylene oxide, esters of monocarboxylic acids and polyols, and the silicon oils including siloxane and silicate oils. Another group of synthetic lubricating oils comprises the esters of dicarboxylic acids, e.g. phthalic acid, succinic acid, alkyl succinic acids and alkenyl succinic acids with a variety of alcohols and glycols e.g. butyl alcohol, hexyl alcohol, dodecyl alcohol, ethylene glycol, propylene glycol. Specific examples of oils include dibutyl adipate, dioctyl sebacate, dioctyl phthalate and the like.

A variety of organic solvents are known and can be used for purposes of this invention. The preferred solvents are substantially non-polar or oleophilic solvents. These preferred solvents include solvents comprising aromatic or aliphatic hydrocarbons. Aromatic solvents include benzene, toluene, xylenes, and fractions from distillation of petroleum. Aliphatic hydrocarbon solvents include hexane, cyclohexane, heptanes, octanes, and similar straight and branched hydrocarbons and mixtures thereof, generally having 4-16 carbon atoms. Included are the aliphatic fractions from the distillation of petroleum including mineral spirits and various mixtures of these solvents in any ratio. Commercial solvents (paraffinic hydrocarbons) are available from Exxon Mobil under the product name ISOPAR.

The preferred corrosion inhibitors are derived from the reaction of at least one sulfonic acid such as petroleum sulfonic acid and at least one carboxylic acid with a metal compound to form a complex. The preferred corrosion inhibitors are derived from the stoichiometric reaction of a metal compound such as an alkaline earth metal with a sulfonic acid e.g. petroleum sulfonic acid and a carboxylic acid preferably at least one or more of the fatty acids to form the metal complex. For example, the sulfonic acids can have the formula $R^1(SO_3H)_y$ or $(R^2)_xR(SO_3H)_y$. Wherein $R^1$ is an aliphatic or aliphatic-substituted cycloaliphatic hydrocarbon containing up to about 30 carbon atoms. When $R^1$ is aliphatic, $R^1$ contains 10 to 20 carbon atoms; when $R^1$ is an aliphatic-substituted cycloaliphatic radical, the aliphatic substituents contain at least 8 carbon atoms. Examples of $R^1$ are alkyl, alkenyl and alkoxy-alkyl radicals, and aliphatic-substituted cycloaliphatic radicals wherein the aliphatic substituents are alkyl, alkenyl, alkoxy, alkoxyalkyl, or carboxyalkyl. The cycloaliphatics can be derived from cycloalkane or cycloalkenes such as cyclopentane, cyclohexane, cyclohexene or cyclopentene. Specific examples of $R^1$ are laurylcyclohexyl, cetyloxyethyl, octadecenyl, and radicals derived from petroleum, saturated and unsaturated paraffin wax, and olefin polymers including polymerized monoolefins and diolefins containing from 2-6 carbon atoms per olefinic monomer.

$R^2$ is a hydrocarbon radical containing from 4-30 aliphatic carbon atoms, preferably aliphatic hydrocarbons such as alkyl or alkenyl. $R^2$ can have substituents or interrupting groups as those set forth above, provided the hydrocarbon character is retained. The radical R can be a cyclic group derived from an aromatic hydrocarbon including benzene, naphthalene, biphenyls, or a heterocyclic group. The subscripts x and y have a value of 1 and can have a value ranging from 1-3.

Specific examples of the sulfonic acids include mahogany sulfonic acids, petroleum sulfonic acids, polywax-substituted naphthalene sulfonic acids, cetylphenol sulfonic acids, cetylphenol sulfonic acids, cetoxycapryl aryl sulfonic acids, dicapryl nitronaphthalene sulfonic acids, paraffin wax sulfonic acids, hydroxy-substituted wax sulfonic acids, tetraisobutylene sulfonic acids, tetra-amylene sulfonic acids, petroleum naphthene sulfonic acids, cetylcyclopentyl sulfonic acids, lauryl cyclohexyl sulfonic acids, mono- and polywax-substituted sulfonic acids, dodecylbenzene sulfonic acids, and the like. These sulfonic acids are well-known in the art, and for purposes of this invention, the equivalent weight of a sulfonic acid is the molecular weight divided by the number of sulfonic acid groups. For example, a monosulfonic acid has an equivalent weight equal to the molecular weight.

The carboxylic acids used in preparing the metal complexes include aliphatic, cycloaliphatic and aromatic mono- and poly carboxylic acids such as naphthenic acids, alkenyl-substituted cyclopentanoic acids, or the alkyl-substituted aromatic carboxylic acids. The aliphatic acids generally contain at least 6 and preferably at least 10 carbon atoms. The cycloaliphatic and aliphatic carboxylic acids can be saturated or unsaturated. Specific examples of the carboxylic acids include 2-ethylhexanoic acid, linolenic acid, substituted maleic acids, behenic acid, isostearic acid, pelargonic acid, capric acid, linoleic acid, lauric acid, oleic acid, ricinoleic acid, undecylic acid, myriatic acid, palmitic acid, acids formed by oxidation of petrolatum or hydrocarbon waxes, and mixtures of two or more carboxylic acids and the like. The preferred carboxy acids include the fatty acids having the formulas $C_nH_{2n+1}$ COOH, $C_nH_{2n-1}$ COOH or $C_nH_{2n-3}$ COOH. The equivalent weight of these carboxylic acids is the molecular weight divided by the number of acid groups. Effective amounts of a hydrocarbon wax such as paraffin, petrolateum and olefin waxes can be added to the corrosion-inhibiting composition to improve the application of the corrosion-inhibiting compositions.

Preferably, the sulfonate-carboxylate metal complexes are derived from alkaline earth metals compound such as calcium, barium or magnesium compounds. These metal neutralizing compounds include the metal oxides, hydroxides, carbonates, bicarbonates and mixtures thereof. These corrosion-resistant metal complexes are derived from the reaction of these metal compounds with stoichiometric amounts of the sulfonic acids and the carboxylic acids to form the metal complex. Commercial sulfonate-carboxylate complexes are available from King Industries under the mark NA-SUL®. The oil soluble organophosphates e.g. alkyl phosphates are derived from phosphorous and phosphoric acids forming the phosphoric acid mono- and diesters including the metal, ammonium or amine salts of these acids. A preferred class of these alkylphosphates are provided by Octel Starreon LLC under the trade name RP-2.

Oil soluble antioxidants are added to the corrosion-resistant compositions in amounts ranging from about 0.1 to 2.0 and preferably from 0.5 to 1.0 parts by weight. The preferred antioxidants are selected from the group consisting of the diphenylamines and derivatives there, alkylated diphenylamines, e.g. the $C_1$-$C_{10}$ alkalated phenylated amines, and phenylnapthylamines and the like. Commercial antioxidants are available from King Industries under the mark NA-LUBE®AO-130. Other useful antioxidants include the oil soluble phenols, hindered bisphenols, sulfurized phenols, sulfurized olefins, alkyl sulfides, disulfides, dithiocarbamates, and the alkylated phenols including the arylalkyl phenols. The phenols include 2-t-butylphenol, 2-sec-butylphenol, 2-isopropylphenol, 2,6-diisopropylphenol, 2-t-octylphenol, 2-cyclopentylphenol, and mixtures thereof.

The water-displacing agents are added to the corrosion-resistant composition in amounts ranging from about 0.1 to 5.0 parts and preferably in amounts of 1.0 to 2.0 parts. These water-displacing agents include the alkoxyalcohols, aliphatic alcohols such as butanol, ethers, ether alcohols, alkylene glycols such as ethylene glycol, diethylene glycol, 2-butoxethanol, 2-methyl-2,4-pentanediol, hexylene glycol, glycol ethers, alkylene glycol ethers and mixtures thereof. Other water displacing agents include the amine salts of various fatty acids and the alkyl diphenylamines. In addition, 0.0 to 1.0 part and preferably 0.1 to 0.5 part of a metal deactivating agent may be added to the corrosion-inhibiting composition. These agents include the heterocyclic compounds and in particular compounds such as benzotriazole, tolyltriazole, thiozoles and mixtures thereof. Commercially available metal deactivators can be obtained from King Industries under the mark K-CORR®.

The following Examples illustrate the oleaginous corrosion-resistant compositions of this invention.

EXAMPLE 1

| | Parts by Weight |
|---|---|
| Mineral Oil | 40.00 |
| Sulfonic acid-carboxylic acid alkaline earth metal complex | 40.00 |
| Organic solvent (aliphatic hydrocarbons) | 20.00 |
| Rust-preventative agent (alkyl ammonium phosphate) | 1.0 |
| Water-displacing agent (alkylene glycol) | 1.5 |
| Antioxidant (diphenylamines) | 1.0 |

EXAMPLE 2

| | Parts by Weight |
|---|---|
| Mineral Oils (paraffinic and naphthenic oils) | 22.50 |
| Non-polar organic solvent | 15.00 |
| Corrosion Inhibitor (sulfonic acid-carboxylic acid metal complex) | 22.50 |
| Antioxidant (diphenylamines) | 0.25 |
| Water-displacing agent (hexylene glycol) | 1.0 |
| Rust-preventative agent (alkyl ammonium phosphate) | 0.50 |
| Metal deactivator (benzotriazole) | 0.10 |

EXAMPLE 3

| | Parts by Weight |
|---|---|
| Lubricating oils (naphthenic and paraffinic oils) | 35 to 45 |
| Organic solvents (petroleum distillates and aliphatic hydrocarbons) | 15 to 30 |
| Corrosion inhibitors (sulfonic acid-carboxylic acid metal complexes, and mixtures with alkyl ammonium phosphates) | 35 to 45 |
| Antioxidants (alkyldiphenylamines) | 0.5 to 1.0 |
| Water-displacing compounds (alkylene glycols) | 1.0 to 2.0 |
| Metal deactivator (heterocyclic compounds) | 0.0 to 1.0 |

The salt spray test results for the corrosion-resistant compositions of this invention are shown in FIG. 1. The test shows the number of days in the salt spray before failure for naphthenic and paraffinic oils on aluminum and steel in comparison to commercial products (corrosion X and ACF-50). FIG. 2 shows salt spray test results on steel panels after wiping-off the corrosion-resistant composition of this invention. The compositions of this invention (formulas 4 and 5) offered more corrosion protection on the steel panels in comparison to corrosion X (corrosion occurred after one hour), and ACF-50 (corrosion occurred after thirty (30) minutes). Formulas No. 4 and No. 5 are substantially the same corrosion-resistant compositions as set forth in the examples of this invention.

For coating automotive or aircraft frames and the like, a solid "hot melt" composition is particularly suitable. For corrosion-inhibiting purposes, the thickened composition of this invention may be applied to the metal surface by methods including brushing, spraying, dip-coating, flow-coating, roller-coating and the like. The viscosity of a thickened composition may be adjusted for the particular method of application by adding an inert organic solvent. The coated metal surface may be dried by exposure to air or baking. If the coating composition is of correct viscosity, the coating or film can be applied directly to the metal surface and the solvent and drying may not be necessary. The film thickness is not critical, however, a coating ranging up to about 5,000 mg. or more per square foot for coatings of aircraft frames or other structural members is sufficient to provide adequate protection.

While this invention has been described by a number of specific examples, it is obvious to one skilled in the art that there are other variations and modifications which can be made without departing from the spirit and scope of the invention as particularly set forth in the appended claims.

The invention claimed:

1. An oleaginous corrosion-inhibiting composition for coating metal surfaces, comprising, in parts by weight, from about, 20 to 60 parts of a lubricating oil of lubricating viscosity selected from the group consisting of mineral oils, synthetic oils and mixtures of mineral oils and synthetic oils, 20 to 60 parts of at least one corrosion-inhibitor selected from the group consisting of a sulfonic acid-carboxylic acid metal complex wherein said metal complex is derived from a stoichiometric reaction of a metal base and the acids, and a mixture of said sulfonic acid-carboxylic acid metal complex with an oil soluble alkyl phosphate wherein said sulfonic acid-carboxylic acid metal complex ranges from about 97 to 99.9% by weight of said mixture, from about, 0.1 to 2.0 parts of an oil soluble antioxidant, from about 0.1 to 5.0 parts of a water-displacing compound selected from the group consisting of alcohols, glycols, ethers, ether alcohols, glycol ethers, and amines, and from about 10 to 40 parts of at least one aliphatic or aromatic organic solvent or a mixture of said solvents.

2. The corrosion-inhibiting composition of claim 1 wherein about 0.1 to 0.5 parts of a heterocyclic metal-deactivating agent is added to the composition.

3. The corrosion-inhibiting composition of claim 2 wherein the heterocyclic-deactivating agent is a triazole.

4. The corrosion-inhibiting composition of claim 3 wherein the metal deactivating agent is a benzotriazole.

5. The corrosion-inhibiting composition of claim 1 wherein the lubricating oil is a paraffinic, naphthenic or a mixture thereof

6. The corrosion-inhibiting composition of claim 1 wherein the lubricating oil is a mixture of synthetic oils and mineral oils.

7. The corrosion-inhibiting composition of claim 1 wherein the sulfonic acid in the sulfonic-carboxylic acid complex is a paraffin-wax sulfonic acid.

8. The corrosion-inhibiting composition of claim 1 wherein the sulfonic acid of the sulfonic acid-carboxylic acid metal complex is a polywax-substituted sulfonic acid.

9. The corrosion-inhibiting composition of claim 1 wherein the sulfonic acid-carboxylic acid metal complex is a calcium alkylarylsulfonate-carboxylate with petroleum oxidate.

10. The corrosion-inhibiting composition of claim 1 wherein the carboxylic acid in the sulfonic acid-carboxylic acid metal complex is an aliphatic, aromatic, cycloaliphatic or fatty acid.

11. The composition of claim 1 wherein the antioxidant is an amine.

12. The corrosion-inhibiting composition of claim 1 wherein the water displacing compound is a glycol.

13. The corrosion-inhibiting compositions of claim 11 wherein the antioxidant is an alkylated phenylamine.

14. A process for inhibiting the corrosion of a metal surface which comprises coating the metal surface with an effective amount of an oleaginous corrosion-inhibiting composition comprising, in parts by weight, from about 20 to 60 parts of a lubricating oil of lubricating viscosity selected from the group consisting of mineral oils, synthetic oils and mixtures of mineral oils and synthetic oils, 20 to 60 parts of at least one corrosion-inhibitor selected from the group consisting of a sulfonic acid-carboxylic acid metal complex wherein said metal complex is derived from a stoichiometric reaction of a metal base and the acids, and a mixture of said sulfonic acid-carboxylic acid metal complex with an oil soluble alkyl phosphate wherein said sulfonic acid-carboxylic acid metal complex ranges from about 97 to 99.9% by weight of said mixture, from about, 0.1 to 2.0 parts of an oil soluble antioxidant, from about 0.1 to 5.0 parts of a water-displacing compound selected from the group consisting of alcohols, glycols, ethers, ether alcohols, glycol ethers, and amines, and from about 10 to 40 parts of at least one aliphatic or aromatic organic solvent or a mixture of said solvents.

15. A process for inhibiting the corrosion of metal surfaces which comprises coating the metal surface with an effective amount of an oleaginous corrosion-inhibiting composition comprising in parts by weight, from about 35 to 45 parts of a lubricating oil of lubricating viscosity selected from the group consisting of mineral oils, synthetic oils and mixtures of mineral oils and synthetic oils, 35 to 45 parts of at least one corrosion-inhibitor selected from the group consisting of a sulfonic acid-carboxylic acid metal complex wherein said metal complex is derived from a stoichiometric reaction of a metal base and the acids, and a mixture of said sulfonic acid-carboxylic acid metal complex with an oil soluble alkyl phosphate wherein said sulfonic acid-carboxylic acid metal complex ranges from about 97 to 99.9% by weight of said mixture, from about, 0.5 to 1.0 parts of an oil soluble antioxidant, from about 1.0 to 2.0 parts of a water-displacing compound selected from the group consisting of alcohols, glycols, ethers, ether alcohols, glycol ethers, and amines, and from about 10 to 40 parts of at least one aliphatic or aromatic organic solvent or a mixture of said solvents.

16. The process of claim 14 wherein about 0.1 to 5.0 parts of a heterocyclic metal-deactivating agent is added to the composition.

17. The process of claim 14 wherein the lubricating oil is a paraffinic, naphthenic or a mixture thereof

18. The process of claim 14 wherein the antioxidant is an aryl amine.

19. The process of claim 15 wherein the sulfonic acid of the sulfonic acid-carboxylic acid metal complex is a polywax-substituted sulfonic acid.

20. The process of claim 15 wherein an effective amount of a hydrocarbon wax is added to the corrosion-inhibiting composition to improve the application of the corrosion-inhibiting composition.

21. The process of claim 15 wherein the sulfonic acid-carboxylic acid metal complex is a calcium alkylaryl-sulfonate-carboxylate with petroleum oxidate.

22. The process of claim 15 wherein the carboxylic acid in the sulfonic acid-carboxylic acid metal complex is aliphatic, aromatic, cycloaliphatic or fatty acid.

* * * * *